US008245557B2

(12) United States Patent
Jacquet et al.

(10) Patent No.: US 8,245,557 B2
(45) Date of Patent: Aug. 21, 2012

(54) PRESS BRAKE FOR BENDING SHEETS

(75) Inventors: Philippe Jacquet, Luceau (FR); Bjarne Hansen, Pontvallain (FR)

(73) Assignee: Amada Co., Ltd., Kanagawa (JP)

( * ) Notice: Subject to any disclaimer, the term of this patent is extended or adjusted under 35 U.S.C. 154(b) by 267 days.

(21) Appl. No.: 12/721,969

(22) Filed: Mar. 11, 2010

(65) Prior Publication Data

US 2010/0229620 A1 Sep. 16, 2010

(30) Foreign Application Priority Data

Mar. 13, 2009 (FR) ..... 09 51614

(51) Int. Cl.
*B21D 9/14* (2006.01)

(52) U.S. Cl. ..... 72/386; 72/389.1; 72/390.4; 72/481.1; 72/482.3; 100/257; 100/291

(58) Field of Classification Search ..... 72/386, 72/389.1–389.4, 390.4, 390.5, 481.1, 482.3; 100/257, 291
See application file for complete search history.

(56) References Cited

U.S. PATENT DOCUMENTS

| | | | | |
|---|---|---|---|---|
| 4,331,020 | A * | 5/1982 | Cros | 72/461 |
| 4,732,032 | A * | 3/1988 | Kogure | 72/389.5 |
| 4,890,476 | A * | 1/1990 | Takahashi et al. | 72/456 |
| 6,401,512 | B1 * | 6/2002 | Gascoin | 72/389.5 |

FOREIGN PATENT DOCUMENTS

| | | |
|---|---|---|
| EP | 1112130 | 4/2002 |
| EP | 1452302 | 9/2004 |
| JP | 2001 121214 | 5/2001 |
| WO | WO 01/43896 | 6/2001 |

OTHER PUBLICATIONS

French Preliminary Search Report corresponding to French application No. 0951609 dated Dec. 11, 2009.

* cited by examiner

*Primary Examiner* — Bena Miller
(74) *Attorney, Agent, or Firm* — Kilpatrick Townsend & Stockton LLP

(57) ABSTRACT

The present invention relates to a bending press or "press brake" for bending metal sheets, wherein the press includes at least one linking rod, which rod is oriented substantially perpendicularly to the movement direction, having one end that is fastened to the deformable portion of the second table and having its other end fastened to the housing.

15 Claims, 5 Drawing Sheets

PRESS BRAKE FOR BENDING SHEETS

FIELD OF THE INVENTION

The present invention relates to a bending press or "press brake" having tables with controlled deformation.

BACKGROUND OF THE INVENTION

Bending presses are machine tools of a type that is itself well known. The machine comprises, as shown in accompanying FIG. 1, a lower table 12 and an upper table 14 that is movable relative to the lower table 12. Usually, the lower table 12 is stationary and the upper table 14 is suitable for being moved towards the lower table 12 under drive from actuators $V_1$ and $V_2$ that act on the ends 14*a* and 14*b* of the upper table. Usually, the lower table 12 has its free edge 12*a* fitted with fastener means 16 for fastening bending matrices 18. In the same way, the edge 14*c* of the upper table 14 is fitted with fastener means 20 for fastening bending punches 22.

A metal sheet or lamination F is placed on the bending matrices 18 of the lower table 12. The sheet F may be of a length that varies widely depending on circumstances. Under drive from the pistons of the actuators $V_1$ and $V_2$, the punches 22 mounted on the upper table move towards the sheet placed on the matrices of the lower table 12. As soon as the punches 22 come into contact with the sheet F, force begins to increase within the sheet as the punches penetrate therein, initially in the elastic range and subsequently in the plastic range, thereby enabling the sheet to be bent permanently.

Because the force is applied to the upper table 14 by the actuators $V_1$ and $V_2$ acting on the ends 14*a*, 14*b* of the table 14, the linear load distributed between the two ends of the tables corresponds to the upper table being deformed along a line in the form of a concave arc with deformation maximas close to the midplane of the table. This means that for bending purposes, at the end of bending, the central portions of the punches 22 have penetrated into the sheet F less than have the end portions. If bending were to be performed on a matrix 18 that, itself, were to remain perfectly straight during bending, then the result would be that a workpiece would be obtained having a bend angle that was wider in its central portion than at its ends. Such a result is naturally unacceptable.

In order to remedy that drawback, various solutions have been proposed for the purpose of controlling these deformations at the edges of the tables in order to obtain a bend that is substantially identical over the entire length of the bent sheet.

Conventionally, those solutions involve providing slots, such as the slots 24 and 26 shown in FIG. 1, that are formed in the lower table 12 symmetrically about the midplane P'P of the press. Those slots 24, 26 then define a central zone 28 of the lower table 12 that does not have slots and that presents a length b, both of the slots 24 and 26 being of length a. With slots 24 and 26 of conventional type, i.e. that leave between them a slot-free portion 28 of length b, substantially parallel deformations are obtained for the edges of the upper and lower tables 14 and 12.

In order to direct the movement of the tables 12, 14 when forces are applied by the actuators $V_1$, $V_2$ for moving the movable table 14 vertically, the frame of the bending press conventionally includes two cheeks 70, 71 for guiding the movable table 14 laterally and for holding the table stationary 12 on the movement axis of the movable table 14, for the entire duration of application of the bending force of the metal sheet or lamination by the actuators $V_1$, $V_2$. The movable table 14 includes rollers so as to promote sliding against the opposite faces of the cheeks 70, 71 with which said table 14 interacts while it is moving. In addition, at the current time, the stationary table includes guide rails that act on the opposite faces of the cheeks 70, 71 when the edge of the table is deformed under the stress of the bending force while bending a metal sheet. These rails are made of a material that limits friction forces. They are generally made of machined steel, of bronze or of synthetic materials. In order to create accurate guidance, without any slack between the cheeks 70, 71 and the deformable portion of the table 12, and also to ensure the best possible rigidity, these guide rails are often subjected to prestress forces by means of spring washers and precise geometric adjustment of their positions.

However, the solution of using guide rails is not entirely satisfactory.

The large number of friction zones as well as the necessary prestressing of the guide rails means that relatively high forces are involved. As a result, the deformations at the edge of the table having slots are poorly controlled, and that may lead to inaccuracies in the positioning of the edge during bending of the metal sheet, especially when the slots are long. In addition, when the edge of the table having slots returns towards its non-deformed position, after bending, vibration may occur. In order to reduce this phenomenon, it is necessary to lubricate the friction faces of the guide rails and/or of the cheeks, and that presents in particular an additional maintenance cost.

In addition, the guide rails are specific parts of cost that is considerable and they may present wear, requiring them to be replaced.

OBJECT AND SUMMARY OF THE INVENTION

The present invention proposes to solve the above-mentioned drawbacks, while improving performance of the desired functions.

The invention thus provides a bending press for bending at least one metal sheet, the press comprising a stationary frame, a first table having an edge fitted with first bending tools, and a second table having an edge situated facing the edge of the first table and fitted with second bending tools, the first table being movable relative to the second table in a movement direction in order to exert a bending force on a sheet disposed between the first and second bending tools, while the second table is held relative to the frame and a deformable portion of the second table is able to deform in the movement direction;

wherein the bending press includes at least one linking rod, which rod is oriented substantially perpendicularly to the movement direction, having one end that is fastened to the deformable portion of the second table and having its other end fastened to the frame.

By means of the invention, any excessive friction and hysteresis behavior is eliminated from the guidance of the deformation of the table having a deformable portion (associated with the presence of slots or any other system making it possible to deform at least one portion of the stationary table so that its edge follows a curve that is parallel to the curve of the edge facing the movable table) while ensuring, at a lower cost, very high operating precision. In addition, the prior art maintenance associated with limiting friction by using lubricants is eliminated since the linking rod does not require such maintenance.

Advantageously, the first and second tables are respectively upper and lower tables, and the movement direction is vertical.

Preferably, the bending press of the invention includes at least one pair of linking rods. In this configuration, and advantageously, both linking rods extend substantially in a plane containing the movement direction.

Advantageously, the bending press includes at least one guide element for guiding the movement of the first table along the movement direction, and, in the embodiment having two linking rods, both linking rods of the pair of linking rods extend in a zone defined by the projection of said guide element in the region of the second table.

Preferably, the bending press of the invention includes two pairs of linking rods that are spaced apart transversally in the movement direction.

Advantageously, the frame presents two cheeks that are substantially parallel to the movement direction and that are spaced apart transversally in said direction.

In an embodiment of the invention, each linking rod presents the shape of a cylinder presenting various different diameters along its axis. In this configuration, provision may be made for the linking rod to present a small-diameter central fraction and large-diameter end fractions.

Advantageously, the large-diameter end fractions of a linking rod are plugged respectively into a portion of the frame and into the deformable portion of the second table.

Advantageously, a segment of the small-diameter central fraction of a linking rod is engaged with clearance in one of the elements constituted by said portion of the frame and said deformable portion of the second table.

In an advantageous aspect of the invention, at rest, each linking rod extends along an axis that is linear, and the rod is flexible so that an end thereof may be offset relative to its linear axis by a value d of up to at least 0.5% of the length of the rod.

In a particularly advantageous aspect of the invention, the second table presents at least one slot, and the deformable portion extends between said slot and the edge of the second table.

Advantageously, each linking rod is made of a material presenting a high modulus of elasticity, i.e. greater than 200 MPa [megapascal], in order to ensure maximum rigidity.

Preferably, each linking rod is made of a material consisting of a steel from the family of manganese-silicon steels or a chromium steel, with vanadium, manganese, or silicon-molybdenum. Naturally, any other material making it possible to obtain sufficient flexibility without risk of breaking, or of plastic deformation may be appropriate.

BRIEF DESCRIPTION OF THE DRAWINGS

Other characteristics and advantages of the invention can be better understood on reading the following description of various preferred embodiments of the invention, given by way of non-limiting example. The description makes reference to the accompanying figures, in which.

MORE DETAILED DESCRIPTION

Below, it is considered that the lower table 12 is the stationary table having slots 24, 26, ideally disposed respectively symmetrically about the midplane P'P of the bending press, while the upper table 14 is the movable table, movable under drive from actuators $V_1$, $V_2$. In addition, the actuators $V_1$, $V_2$ have guide means (not shown in the figures), for guiding the movement of the upper table 14 vertically, along the movement axis D of the upper table 14 and of the deformable portion 112 of the lower table 12.

Figure 1:
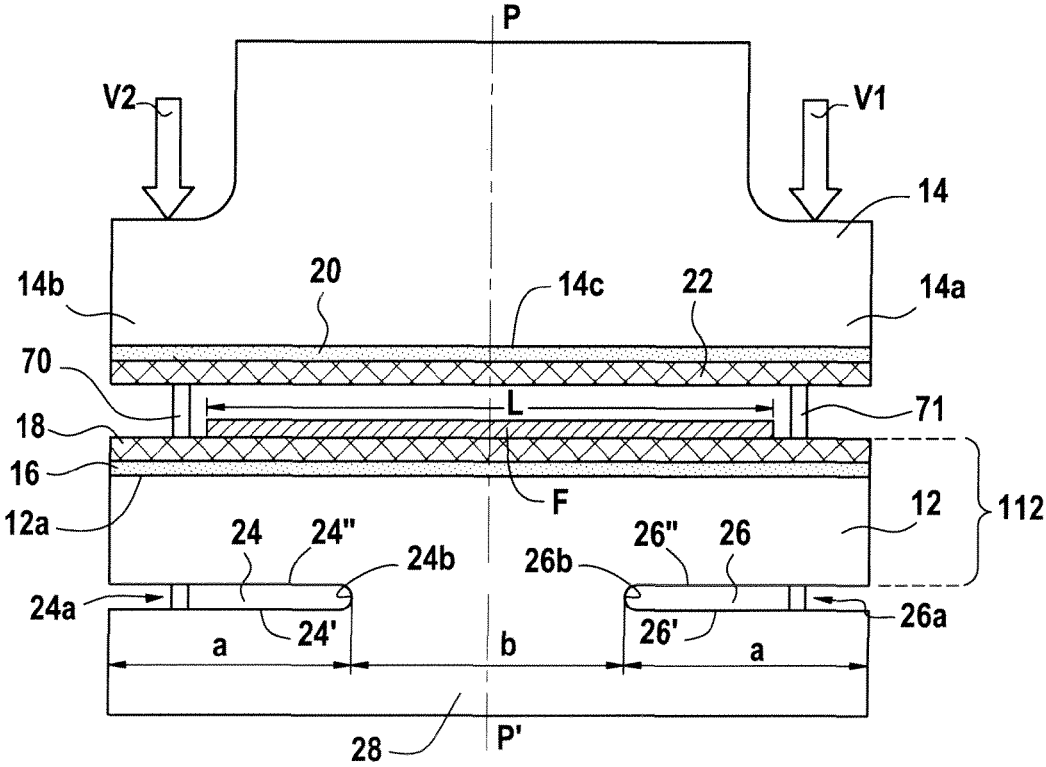
FIG. 1 shows a bending press with two slots situated respectively on either side of the midplane P'P and extending from opposite sides of the lower table.

As explained above with reference to FIG. 1, under drive from the pistons of the actuators $V_1$ and $V_2$, situated at the two opposite ends on the movable table 14, the top portion 112 of the stationary table 12, i.e. the portion of the table 12 situated between the slots 24 and 26 and the top edge 12*a* of the lower table 12, moves, or becomes curved, as a result of the movement D.

The present invention provides a solution for accompanying or guiding the movement of the deformable portion 112 of the lower table 12 in such a manner that the movement of the deformable portion 112, during and after the application of the bending force, takes place within a vertical prism containing the table 12, without any lateral movement of said deformable portion 112. The term "lateral movement" of the deformable portion 112 of the lower table 12 should be understood as referring to any movement that is not contained within the space defined between two parallel axes $X_1X_2$ and $X_3X_4$, shown in FIG. 5, and corresponding respectively to the axes of the opposite edges of the lower table 12.

Figure 2A:
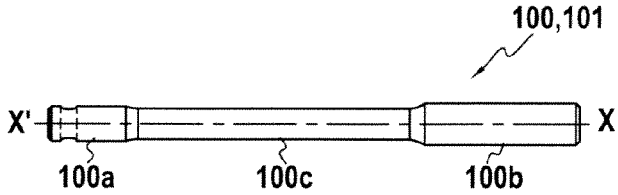
FIGS. 2A and 2B are views of an embodiment of a linking rod of the invention.
Figure 2B:
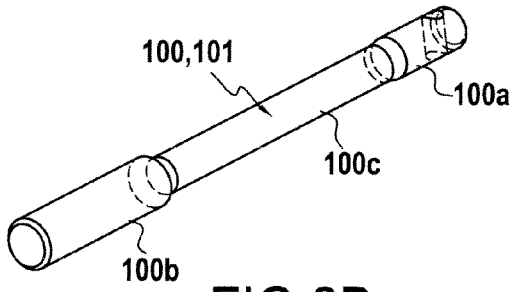

FIGS. 2A and 2B show an embodiment of a linking rod 100 of the invention. The linking rod 100 extends along the axis X'X and comprises three substantially cylindrical fractions, two end fractions 100*a* and 100*b* and one central fraction 100*c* between said two end fractions 100*a* and 100*b*. The end fractions 100*a*, 100*b* are of diameter that is larger than that of the central fraction 100*c* in such a manner that said central fraction 100*c* presents greater capacity for elastic bending. Thus, the linking rod 100, fastened by one of its ends 100*a* or 100*b* to the deformable top portion 112 of the lower table 12 and by its other end 100*a* or 100*b* to the frame of the bending press, is capable, by means of said elastic bending of the central fraction 100*c*, of accompanying the movement or the deformation of the top portion 112 of the lower table 12 when the bending force is applied to the metal sheet F.

It should be noted that the end 100*b* of the linking rod 100 presents a diameter that is greater than that of the end 100*a*.

Figure 3:
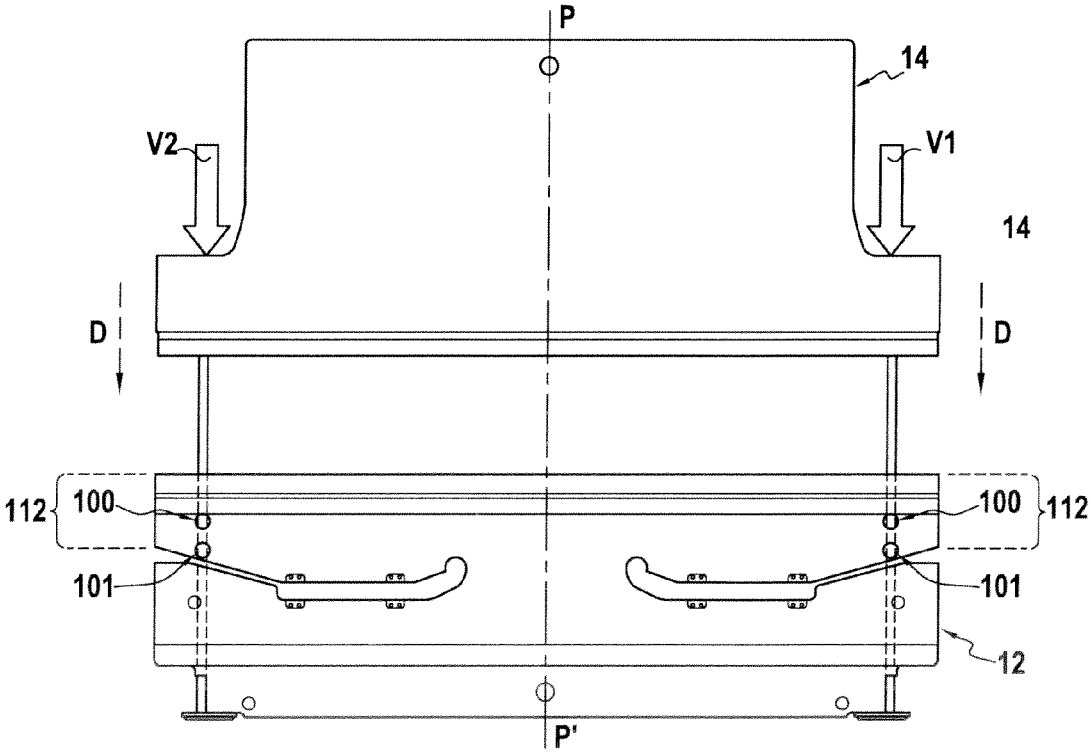
FIG. 3 shows a front view of the bending press of the invention with parallel lateral guide axes on which there are mounted two respective pairs of linking rods of the invention.

In FIG. 3, two pairs of linking rods 100, 101 are fastened to the lower table 12. Said two pairs of linking rods 100, 101 are placed at a distance from each other in the proximity of opposite edges of the lower table 12. Each linking rod 100 or 101 is fastened by one of its ends 100*a* or 100*b* to the deformable portion 112 of the table 12, and its other end 100*a* or 100*b* is fastened to one of the two cheeks 70, 71 of the frame of the bending press. Each of the lateral guide cheeks 70, 71 extends vertically below a respective one of the two actuators $V_1$, $V_2$. The cheeks 70, 71 extend perpendicularly to the plane of the lower table 12 and substantially parallel to the movement direction D.

Figure 4:
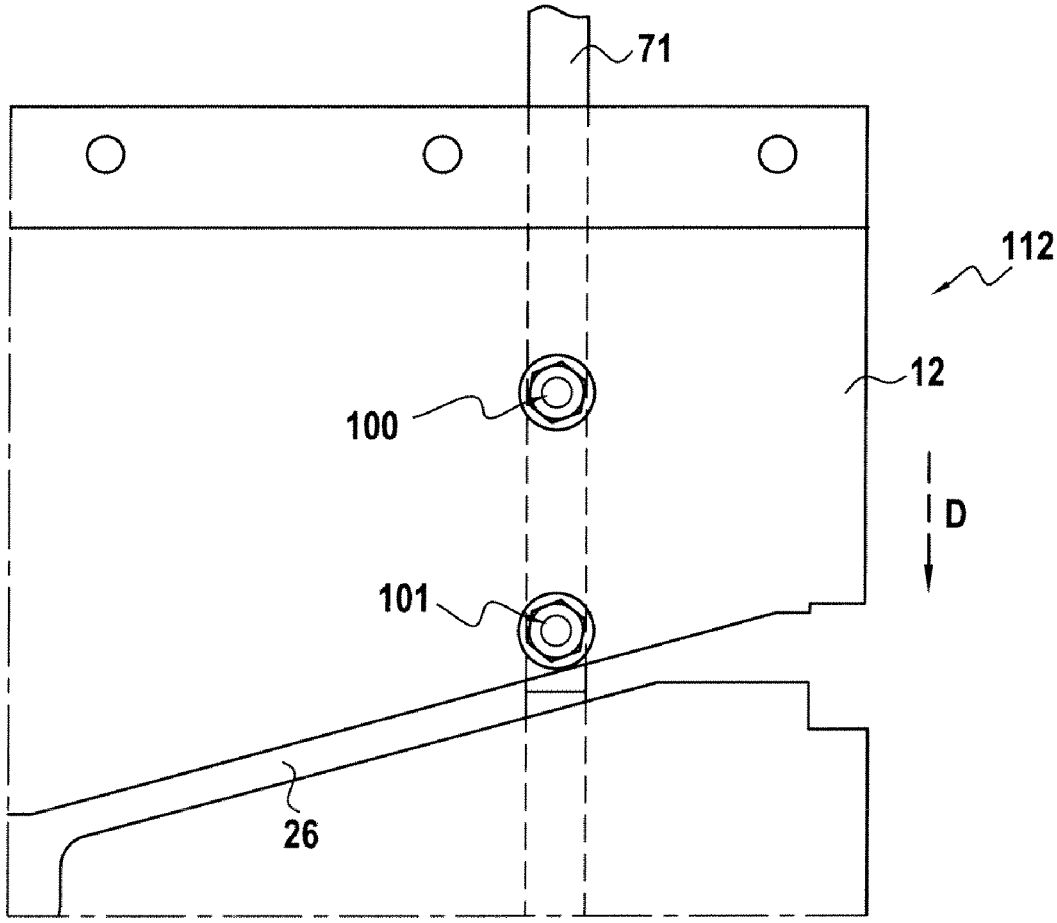
FIG. 4 is a larger-scale view of a fragment of the bending press shown in FIG. 3 with one of the two pairs of linking rods.
Figure 5:
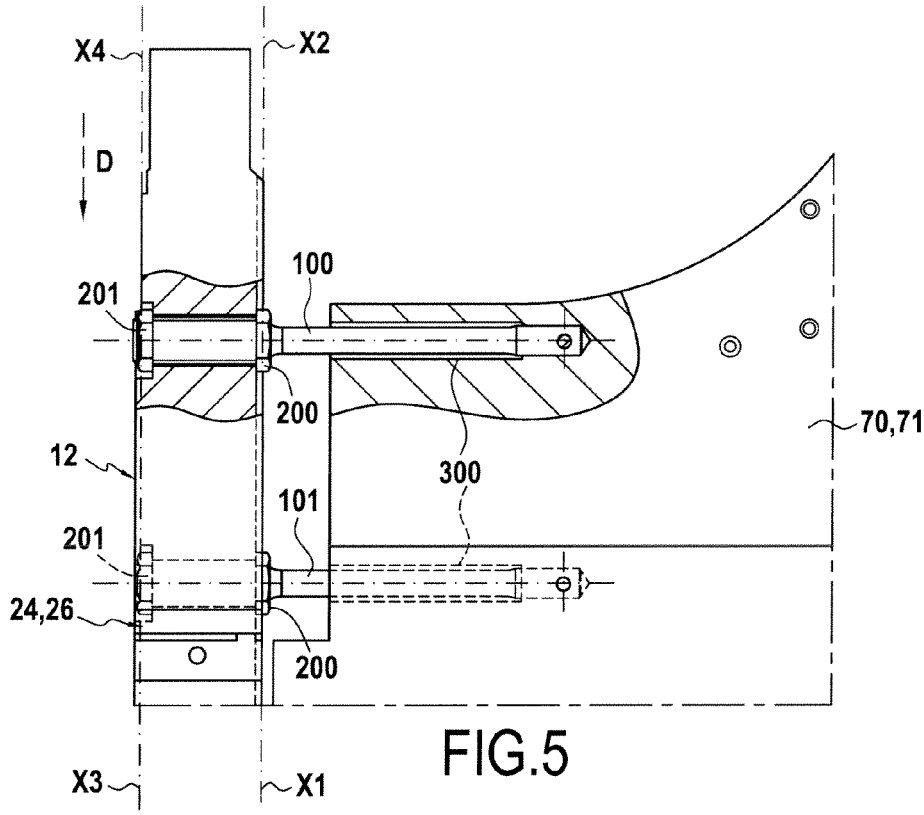
FIG. 5 is a side view of FIG. 4.
Figure 6:
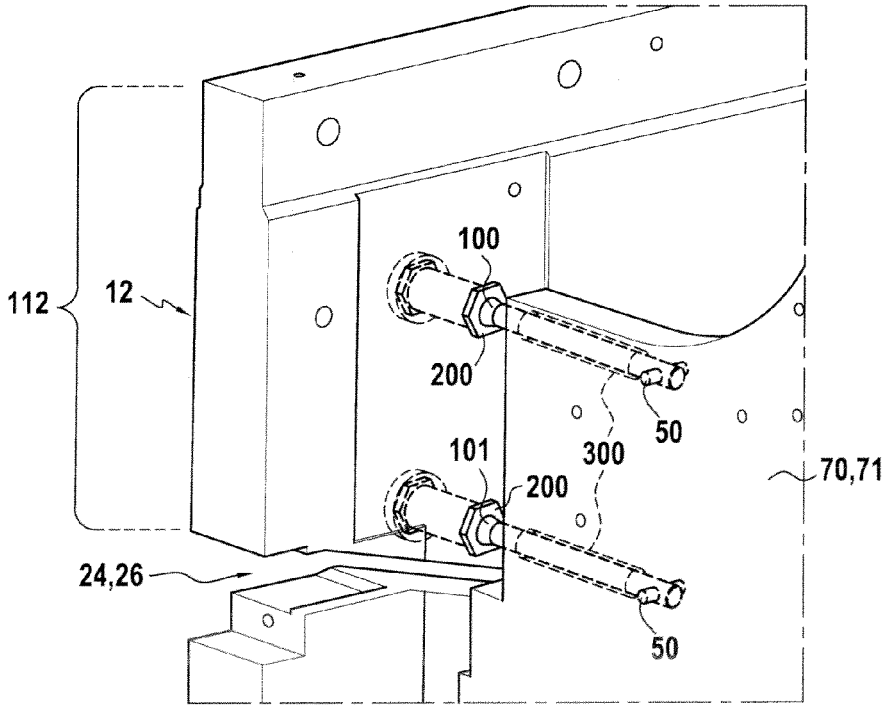
FIG. 6 is a perspective view showing a lateral guide cheek and a fragment of a lower table, which elements are connected together by a pair of linking rods.

As can be seen in FIGS. 4 to 6, the two linking rods 100, 101 of a single pair extend in the plane of the cheeks 70, 71, and therefore perpendicularly to the plane of the lower table 12.

The ends 100*b* of the linking rods 100, 101 are fastened in the deformable portion 112 of the table 12 by conventional mechanical means. In this embodiment, two nuts 200, 201, are engaged on opposite ends of the end fraction 100*b* and against the opposite edges of the table 12, thereby rigidly fastening the end fraction 100*b* in the table 12. Provision may also be made for the orifices in the deformable portion 112 in which the ends 100*b* of the linking rods 100, 101 are inserted to be tapped while the ends 100*b* are tapped in such a manner as to co-operate with the tapping of said orifices.

In the example chosen to illustrate the invention, the ends 100*b* of the linking rods 100, 101 present a length equal to the thickness of the lower table 12. The other end 100*a* of each of the linking rods 100, 101 is plugged into a housing 300 of diameter substantially equal to the diameter of the end 100*a*. The end 100*a* of the linking rod 100, 101 is in this embodiment fastened to the cheek 70, 71 by means of a pin 50. The cheeks 70, 71 and the ends 100*a* of the linking rods 100, 101 include respective transverse orifices of substantially the same diameter; each of said orifices passing through both a cheek 70 or 71 and the end 100*a* of the corresponding linking rod 100, 101. When the end 100*a* is plugged home into the housing 300 of a cheek 70, 71, the orifice of the end 100*a* is in register with the orifice of the cheek 70, 71 in such a manner that the pin 50 can be introduced through the cheek 70 or 71 and into the end 100*a* of the linking rod 100, 101 in order to secure the linking rod 100, 101 to the cheek 70, 71.

The linking rod 100, 101 is fastened via a plurality of fastening points at its end 100*b* and this constitutes a particularly rigid fastening, specifically by two nuts 200, 201 in the embodiment shown in the accompanying figures, whereas the linking rod 100, 101 is fastened at only one fastening point or axis at its end 100*a*. The ends 100*a*, 100*b* are fastened to the table 12 and to the cheek 70, 71 either permanently or separably. For fastening that is not separable, said fastening of the ends 100*a*, 100*b* respectively to the table 12 and to the cheek 70, 71 could be performed by welding or adhesive, while for a fastening that is separable, the ends could be screw-fastened, key-fastened or mechanically fastened in some other way.

In addition, because the central fraction 100*c* of the linking rod 100, 101 presents a diameter that is less than the diameter of the ends 100*a*, 100*b*, and because the housing 300 presents a diameter that is substantially greater than the diameter of the end 100*a*, the central fraction 100*c* has the ability to travel or bend inside the housing 300. Thus, even for maximum bending of the central fraction 100*c* of the linking rod 100, 101, said rod 100, 101 does not touch the edges at the entrance to the housing 300. It should be noted that a linking rod 100, 101 presents very high rigidity in traction/compression along its longitudinal axis X'X.

In the embodiment having a pair of linking rods 100, 101 fastened to a cheek 70 or 71 and to the deformable portion 112 of the table 12, the ends 100*a*, 100*b* of said rods form the four vertices of a deformable parallelogram, between the cheek 70 or 71 and the deformable portion 112 of the table 12. Naturally, by using a pair of linking rods 100, 101 instead of only one linking rod 100, 101, guidance of the deformable portion 112 of the table is particularly improved. In addition, the invention is not limited to the use of pairs of linking rods: for each set of linking rods it is possible to provide more than two linking rods 100, 101.

Figure 7:
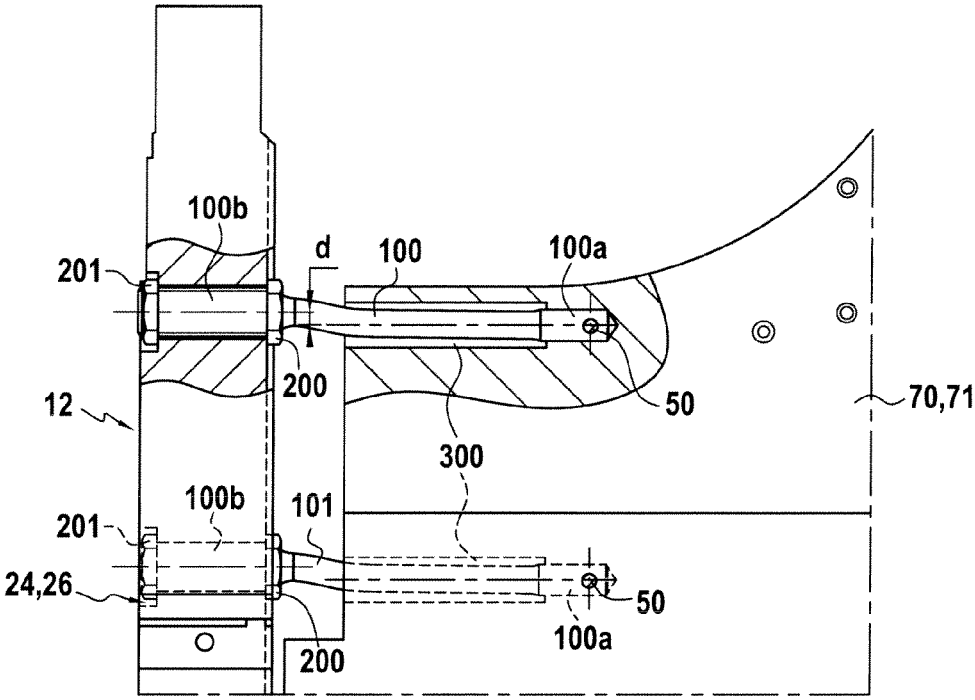
FIG. 7 is a section view of a lateral guide cheek and a fragment of a lower table together with a pair of linking rods, in the absence of load on the lower table.
Figure 8:
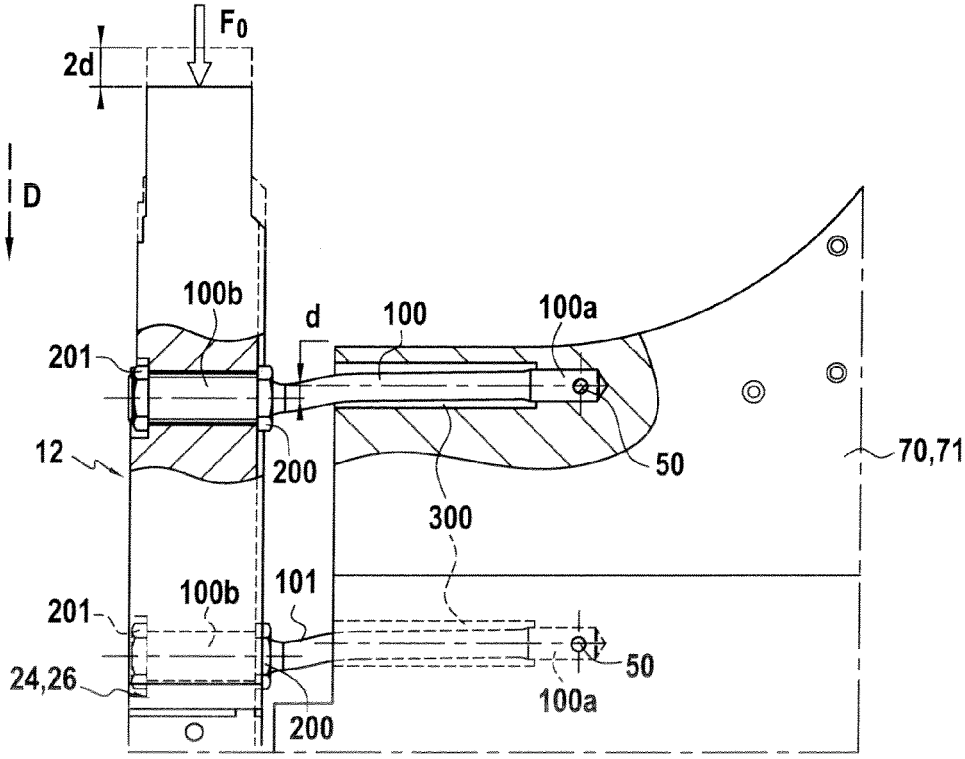
FIG. 8 is a view that is identical to FIG. 7 when the lower table is under full load.

FIGS. 7 and 8 show a pair of linking rods 100, 101, respectively in the absence of load on the lower table 12 and when said table 12 is under full load. In its initial state, in the absence of load, the central fraction 100*c* of the linking rod 100, 101 presents bending so that there is a vertical offset d between its end 100*b* and its end 100*a*; the end 100*b* being higher than the end 100*a*. The offset d between the ends 100*a* and 100*b* of the linking rod 100, 101 constitutes prestressing of the rod 100, 101. When the force $F_0$ is applied to bend the metal sheet or lamination F, this initial prestress is reduced to zero (half way through the stroke of the lower table 12), and then the lower table 12 is moved once more through a distance d in the movement direction D in such a manner that the final stress is equal in value and opposite in sign to the prestress acting initially (at rest) on the linking rod 100, 101. The advantage of having an initial offset d between the ends 100*a* et 100*b* in the opposite direction to the movement D (i.e. the end 100*b* fastened to the deformable portion 112 of the lower table 12 is higher, by a distance d, than the end 100*a* fastened in the cheek 70 or 71) lies in the linking rod 100, 101 having greater capacity for bending when the deformable portion 112 of the table 12 moves. This makes it possible to guide the deformable portion 112 of the lower table 12 over a longer stroke, and in the embodiment in FIGS. 7-8 a stroke over a distance 2*d*. If it is decided to apply prestress to the linking rod 100, 101 in such a manner that its end 100*b* is offset by a maximum distance (within its ability to bend without plastic deformation) relative to the end 100*a* and in the opposite direction to the movement D, then the linking rod 100, 101 is guided over a distance that is twice its maximum offset, in such a manner as to enable the deformable portion 112 to curve ideally, so that the ends of the edges 12*a* of the table 12 do indeed deform parallel to the bottom edge 14*c* between the ends 14*a*, 14*b* of the table 14. By way of example, if the initial offset (in the opposite direction to the movement D) between the two ends 100*a* and 100*b* is equal to 1 mm [millimeter], then the length of the stroke over which the deformable portion 112 of the lower table 12 is guided by the linking rod can be equal to at least 2 mm.

By way of example, a linking rod 100, 101 has a length of 150 mm for an average diameter (average of the diameters of the various fractions 100*a*, 100*b* and 100*c* of the linking rod 100, 101) of 14 mm. In this configuration, the vertical offset between the two ends 100*a* and 100*b* of the linking rod 100, 101 may lie in the range 0 and 1.5 mm.

What is claimed is:

1. A bending press for bending at least one metal sheet, the press comprising a stationary frame, a first table having an edge fitted with first bending tools, and a second table having an edge situated facing the edge of the first table and fitted with second bending tools, the first table being movable, relative to the second table in a movement direction in order to exert a bending force on a sheet disposed between the first and second bending tools, while the second table is held relative to the frame and a deformable portion of the second table is able to deform in the movement direction, the bending press including at least one linking rod, which rod is oriented substantially perpendicularly to the movement direction, having one end that is fastened to the deformable portion of the second table and having the other end of said rod fastened to the frame.

2. A bending press according to claim 1, wherein the first and second tables are respectively upper and lower tables, the movement direction being vertical.

3. A bending press according to claim 1, including at least one pair of linking rods.

4. A bending press according to claim 3, wherein both linking rods extend substantially in a plane containing the movement direction.

5. A bending press according to claim 1, including at least one guide element for guiding the movement of the first table along the movement direction.

6. A bending press according to claim 5, including at least one pair of linking rods, both linking rods of the pair of linking rods extending in a zone defined by the projection of said guide element in the region of the second table.

7. A bending press according to claim 1, including two pairs of linking rods that are spaced apart transversally in the movement direction.

8. A bending press according to claim 7, wherein the frame presents two cheeks that are substantially parallel to the movement direction and that are spaced apart transversally in said movement direction.

9. A bending press according to claim 1, wherein each linking rod presents the shape of a cylinder presenting various different diameters along axis thereof.

10. A bending press according to claim 9, wherein the linking rod presents a small-diameter central fraction and large-diameter end fractions.

11. A bending press according to claim 10, wherein the large-diameter end fractions are plugged respectively into a portion of the frame and into the deformable portion of the second table.

12. A bending press according to claim 11, wherein a segment of the small-diameter central fraction of a linking rod is engaged with clearance in one of the elements constituted by said portion of the frame and said deformable portion of the second table.

13. A bending press according to claim 1, wherein, at rest, each linking rod extends along an axis that is linear, and the rod is flexible so that an end thereof may be offset relative to its linear axis by a value of up to at least 0.5% of the length of the rod.

14. A bending press according to claim 1, wherein the second table presents at least one slot, and wherein the deformable portion extends between said slot and the top edge of the second table.

15. A bending press according to claim 1, wherein each linking rod is made of a material presenting a high modulus of elasticity.

* * * * *